US006190338B1

(12) United States Patent
Arndt

(10) Patent No.: US 6,190,338 B1
(45) Date of Patent: Feb. 20, 2001

(54) THERAPEUTIC MASSAGE TABLE

(75) Inventor: Gerald Dittmar Arndt, Chattanooga, TN (US)

(73) Assignee: Chattanooga Group, Inc., Hixson, TN (US)

( * ) Notice: Under 35 U.S.C. 154(b), the term of this patent shall be extended for 0 days.

(21) Appl. No.: 09/166,249

(22) Filed: Oct. 5, 1998

(51) Int. Cl.[7] ..... A61H 15/00

(52) U.S. Cl. ..... 601/115; 601/99; 601/98; 601/102; 601/103; 601/112

(58) Field of Search ..... 601/46, 49, 51–54, 601/63, 89, 90–94, 97–99, 100, 101–103, 115, 116, 118, 126, 130, 112, 113, 127, 128; 5/632, 633; 606/240, 241, 242

(56) References Cited

U.S. PATENT DOCUMENTS

| | | | | |
|---|---|---|---|---|
| 1,593,014 | | 7/1926 | Bushmiller . | |
| 2,492,406 | * | 12/1949 | Thomas | 601/99 |
| 2,534,587 | | 12/1950 | Fisher et al. . | |
| 2,909,173 | | 10/1959 | Anderson . | |
| 3,523,524 | | 8/1970 | Wilson . | |
| 3,687,133 | | 8/1972 | Grubelic . | |
| 3,830,233 | | 8/1974 | Hill . | |
| 3,882,856 | * | 5/1975 | Heuser et al. | 601/99 |
| 4,011,862 | | 3/1977 | Kosiak . | |
| 4,154,232 | | 5/1979 | Fukazawa . | |
| 4,190,043 | | 2/1980 | Thompson . | |
| 4,718,408 | * | 1/1988 | Barreiro | 601/102 |
| 5,038,757 | * | 8/1991 | Yamasaki | 601/116 |
| 5,088,475 | | 2/1992 | Steffensmeier . | |
| 5,103,808 | * | 4/1992 | Iams et al. | 601/134 |
| 5,109,558 | * | 5/1992 | Di Blasi | 5/611 |
| 5,137,016 | * | 8/1992 | Yamasaki et al. | 601/102 |
| 5,385,531 | * | 1/1995 | Jover | 601/49 |
| 5,626,555 | * | 5/1997 | Di Blasi et al. | 601/98 |
| 5,772,614 | * | 6/1998 | Lindquist | 601/116 |
| 5,940,911 | * | 8/1999 | Wang | 5/610 |

FOREIGN PATENT DOCUMENTS

| | | | | |
|---|---|---|---|---|
| 4210 | * | 4/1904 | (GB) | 601/68 |

* cited by examiner

*Primary Examiner*—Justine R. Yu
(74) *Attorney, Agent, or Firm*—Chambliss, Bahner & Stophel, P.C.

(57) ABSTRACT

A method and apparatus is disclosed for providing therapeutic musculoskeletal massage to a patient. The apparatus comprises a table having a plurality of roller assemblies, each of which is mounted on a support rail that is attached to the table. The roller assemblies each have rollers and extension arms of differing sizes, lengths, and contours that are specifically designed and selected to provide optimal therapeutic effect to a specific portion of a patient's spine.

12 Claims, 4 Drawing Sheets

THERAPEUTIC MASSAGE TABLE

FIELD OF THE INVENTION

The present invention relates to the field of therapeutic devices, and more particularly to massage tables, beds or chairs designed to apply therapeutic pressure along the spine of a reclining patient.

BACKGROUND OF THE INVENTION

In order to counteract the deleterious effects of gravity, poor posture or excessive weight on the spine, and in order to provide treatment for various disorders of the spine, therapists and doctors have used specially designed tables to generate intersegmental traction on the spine, by imposing motion on the various anatomical segments of the spine. In this way, pressure on spinal nerves may be relieved, and the flow of spinal fluid in the spinal column and of blood in the musculature and other tissues adjacent to or overlying the spine may be increased.

It is known to provide such massage or treatment tables that include roller assemblies that are designed to contact at least a portion of the spine of a patient and apply rolling pressure thereto. Most of these devices employ a plurality of rollers, all of the same size, for applying pressure to various areas of the spine. Some, such as those of U.S. Pat. No. 5,088,475 of Steffensmeier, U.S. Pat. No. 3,687,133 of Grubelic and U.S. Pat. No. 2,909,173 of Anderson, include a plurality of rollers that are mounted on a carriage that moves back and forth along the spine of a patient beneath the top surface of a table on which the patient is reclining. Others, such as those of U.S. Pat. No. 4,190,043 of Thompson, U.S. Pat. No. 4,154,232 of Fukazawa and U.S. Pat. No. 3,830,233 of Hill, include a reciprocating table top that moves a patient back and forth above a roller assembly. In some of these known massage tables, the rollers may also be mounted on a support that pivots about a point on a fixed frame or on the moving carriage. Thus for example, the Steffensmeier table includes three pairs of tandem rollers of the same size that are rotatably mounted on a common support plate that is also rotated about a central axis on the carriage as it travels along a track from one end of the table to the other. The Thompson table also includes three rollers of the same size that are mounted on a common support plate like that of Steffensmeier. The Thompson support plate is rotated about a central drive shaft, so that the rollers sequentially contact the patient who is moving back and forth on the reciprocating table top. Each of the rollers in these devices will contact a portion of the spine as the rollers and the patient move with respect to each other. All of these devices require a complicated reciprocating mechanism of some sort, either to move a roller assembly beneath a reclining patient or to move the patient above a roller assembly.

Other known devices, such as those of U.S. Pat. No. 4,011,862 of Kosiak and U.S. Pat. No. 3,523,524 of Wilson, include an endless belt or conveyor which carries a number of rollers of the same size along a track beneath a table top so that the rollers move along the spine of the patient that is exposed by the table top. However, these conveyor-type devices are complicated mechanisms that are expensive to build and operate and more likely to be subject to mechanical failure than is a simpler device.

Most of the known massage or treatment tables operate by urging the rollers upwardly in a uniform manner along the length of the spine of the reclining patient. Many of these tables employ rollers having the same diameter and curvature for contact with all regions or areas of the patient's spine. However, the presentation of a constant force at the upper surface of the treatment table will not generally result in the application of a consistent therapeutic force to the various areas of the spine of the patient reclining thereon, because the human spine is not straight, even when the patient is reclining on a table. The normal spine exhibits a nearly "S" shaped physiological curvature, lordotic in the lumbar and cervical regions and kyphotic in the thoracic region. Because of this normal curvature, the spine of a patient reclining on a table will likely be in intimate contact with the surface of the table in the thoracic region, but will likely arch away from the surface in the lumbar and cervical regions. Therefore, the known tables do not adequately apply the same massage or therapeutic pressure with the rollers to all regions of the spine. If the rollers are sized and mounted so as to apply appropriate pressure to the lumbar portion of the patient's spine, for example, they may apply too great a pressure to the thoracic portion, causing the patient to experience discomfort or pain as a roller passes over the thoracic portion. On the other hand, if the rollers are appropriately size and mounted to apply effective pressure to the thoracic portion of the spine, for example, they may not apply sufficient pressure to the lumbar portion.

The Grubelic and Fukazawa devices attempt to compensate for this deficiency by providing a suspended flexible platform on which the patient may recline. However, the Grubelic device employs a complicated arrangement of rocker arms carrying pairs of rollers at each end to apply pressure at various points along the spine of the patient. The Fukazawa device suspends the platform from each end in the manner of a hammock above eccentrically rotated rollers that slide as they rotate in contact with the lower side of the hammock. Because the Fukazawa rollers both slide and rotate, the massaging force applied to each particular area of the spine is varied between a strong and a weakened force as the treatment progresses.

The Wilson and Kosiak devices attempt to apply uniform pressure by curving the track of the conveyor carrying the rollers to match the curvature of the patient's spine. The curvature of the Wilson track is adjustable to match the spinal curvature of an individual patient, but adjustment of this device requires the adjustment of a number of vertical adjusting rods to which the track is affixed. This is a time-consuming process and may be difficult to accomplish in an efficient manner.

It is apparent that many of the known therapeutic massage tables suffer from the inability to apply an anatomically adjusted or therapeutically consistent rolling force or pressure to the various regions of the spine. Many of the known devices are also complicated structures that are expensive to build and operate and more likely to be subject to mechanical breakdown.

OBJECTS OF THE INVENTION

It is an object of the present invention, therefore, to provide a therapeutic massage table having a plurality of rollers which are designed in size and shape to apply an anatomically adjusted and therapeutically consistent rolling force to the various specific regions of a patient's spine. It is another object of the present invention to provide such a table that employs a plurality of roller assemblies which are activated or rotated sequentially so as to simulate the effect of a single roller applying therapeutic pressure along the entire length of the patient's spine. It is yet another object of this invention to provide a therapeutic massage table of relatively simple construction, with fewer moving components than conventional tables, that may be employed to apply an anatomically adjusted and therapeutically consistent rolling force to the various regions of a patient's spine.

Additional objects and advantages of this invention will become apparent from an examination of the drawings and the ensuing description.

EXPLANATION OF TECHNICAL TERMS

As used herein, the term table refers to a generally planar surface on which a person may recline, and includes beds and chairs that are or may be disposed in a reclining position.

As used herein, the term spine refers to the human spinal column or vertebral column, as well as the musculature and other tissues of the back which overlie or are adjacent thereto.

SUMMARY OF THE INVENTION

The present invention comprises a therapeutic massage table which includes a frame that is adapted for supporting a top upon which a patient may recline for treatment. The table also includes a support rail that is attached to the frame, and a plurality of roller assemblies. Each roller assembly includes an arm having a first end and a second end. A roller is rotatably attached to the first end, and the second end is rotatably attached to the support rail. Means are also provided for rotating each of the roller assemblies about its point of attachment to the support rail. The support rail is positioned with respect to the table top such that when the roller assemblies are rotated about their points of attachment on the support rail, the rollers will apply pressure to the patient on the top of the table. In a preferred embodiment of the invention, the roller assemblies are sequentially rotated about their points of attachment on the support rail so that the rollers will apply pressure to the spine of a patient lying on the table top in a manner that simulates the effect of a single roller passing along the length of the patient's spine. Unlike the known devices, where rollers of one size and shape are used to accommodate the entire spine, a preferred embodiment of the present invention provides a plurality of rollers, each being sized and shaped to apply consistent therapeutic pressure to a particular portion of the patient's spine. The preferred embodiment of the invention also contemplates selecting the length of each of the arms of the roller assemblies so as to optimize the therapeutic pressure applied by each specific roller to the portion of the spine which it is intended to contact. Finally, the preferred embodiment of the invention provides a support rail that may be adjusted with respect to the table top to customize the therapeutic pressure applied to the spine of each individual patient.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENT OF THE INVENTION

Figure 1:
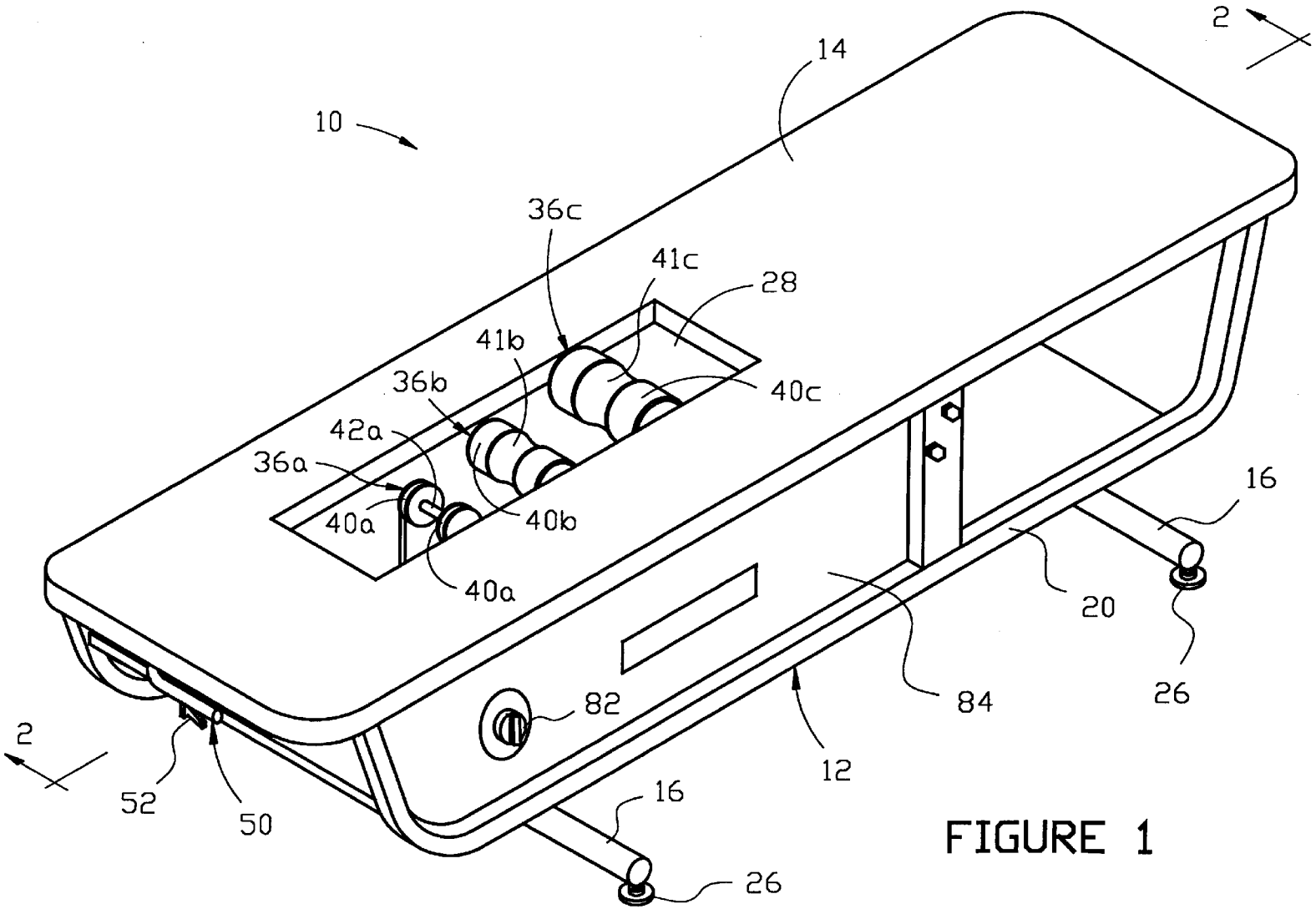
FIG. 1 is a perspective view of a preferred embodiment of the invention.

A preferred embodiment of the invention is illustrated in the drawings. As shown in FIG. 1, therapeutic massage table 10 includes frame 12, which is adapted for supporting a top 14 upon which a patient may lie or recline for treatment. Frame 12 is preferably provided in the form of tubular steel or other suitable material, includes front and rear base portions 16 and leg portions 18 (see FIGS. 2 and 3), left and right main supports 20 and top supports 22, and center support 24 (see FIGS. 2 and 3), the purpose and function of which shall be subsequently explained. Base portions 16 of preferred frame 12 are also provided with leveling feet 26, which are adjustable to level the table on the floor. Frame 12 should be designed so as to support the weight of a patient seeking treatment. Top 14 is preferably comprised of a board that is preferably made of wood, plastic or metal and covered with padding and a soft cover of leather or vinyl material (not shown) to insure the comfort of the patient. The board and padding of the top will preferably be provided with cut-out 28 which is generally located in the middle of the top and extends along the length of the table a distance sufficient to afford treatment to the average person. The cut-out defines the treatment area and is preferably about 25 inches in length and wide enough to accommodate the roller having the greatest length. The soft cover for the table top may cover the cut-out or leave it uncovered as desired.

Figure 2A:
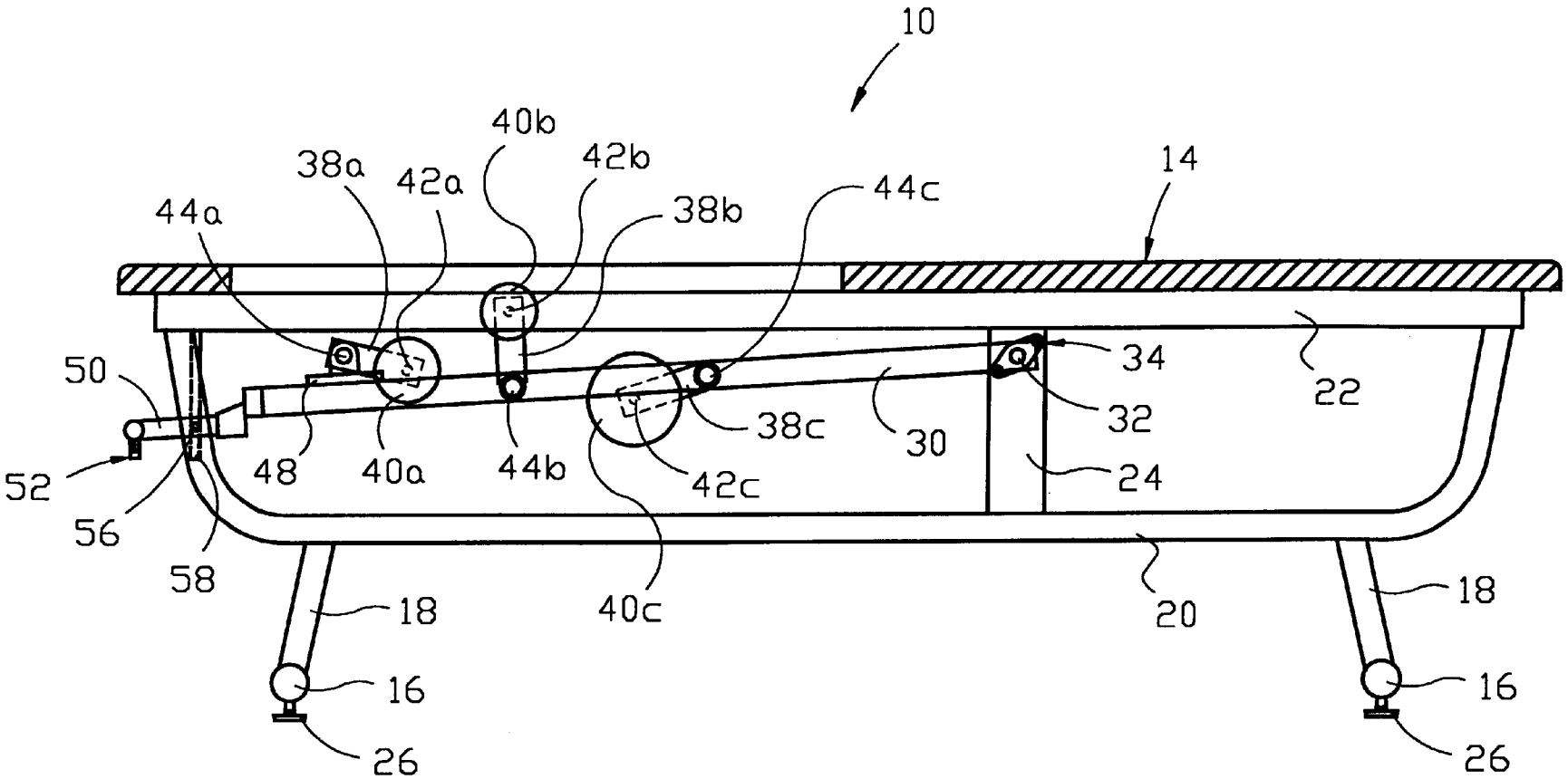
FIG. 2A is a cross-sectional view of the table of FIG. 1 taken along the line 2—2 of FIG. 1, and illustrating the support rail in a lowered position.
Figure 2B:
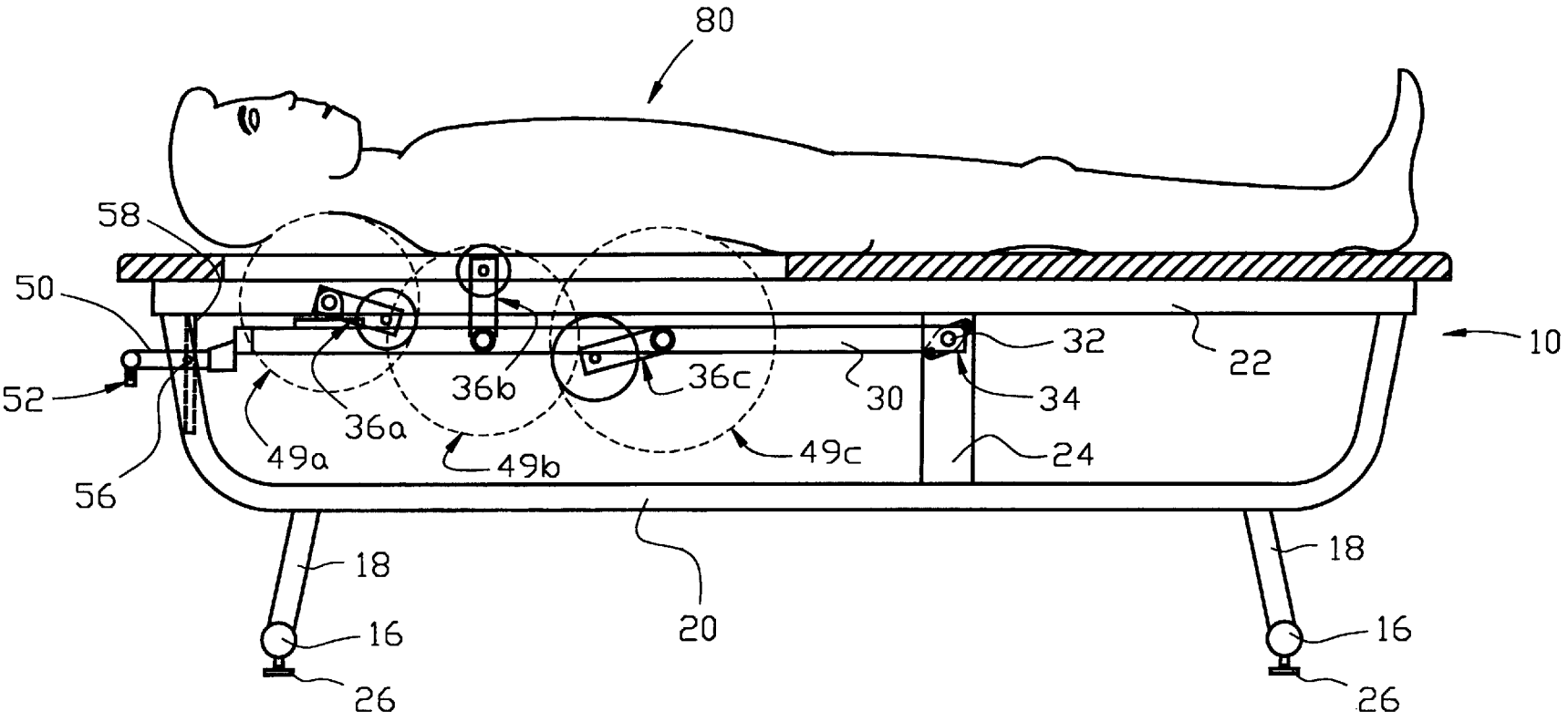
FIG. 2B is a cross-sectional view of the table of FIG. 1 taken along the line 2—2 of FIG. 1, illustrating the support rail in a raised position, and illustrating the application of therapeutic massaging pressure to the spine of a patient according to the invention.

As shown in FIGS. 2A and 2B, table 10 further includes support rail 30, which is pivotally attached by pivot pin 32 to center support 24 of frame 12 and secured thereto by a pair of brackets 34, only one of which is shown in the drawings. Table 10 also includes roller assemblies 36*a*, 36*b* and 36*c*, each of which includes an extension arm 38*a*, 38*b* or 38*c* and a roller 40*a*, 40*b* or 40*c* (see FIG. 2A). Each of rollers 40*a*, 40*b* and 40*c* is rotatably attached to a first end of the appropriate arm 38*a*, 38*b* or 38*c* by means of a pin 42*a*, 42*b* or 42*c* . The second end of each of arms 38*b* and 38*c* is rotatably attached to the support rail by means of a pin 44. The second end of arm 38*a* is rotatably attached to the support rail by means of pin 44*a* and bracket 48. Table 10 also includes means, described in more detail hereinafter, for rotating each of roller assemblies 36*a*, 36*b* and 36*c* about its point of attachment on support rail 30.

Referring once again to FIGS. 1 and 2B, rollers 40*a*, 40*b* and 40*c* are preferably provided in different diameters and lengths. In addition, the rollers may be made of materials having outer surfaces with various textures and hardnesses, including foam or sponge rubber, hard rubber, plastic and wood. Furthermore, the rollers may be provided in pairs, such as is illustrated for assembly 36*a* (see FIG. 1), or in unitary form, such as is illustrated for assemblies 36*b* and 36*c*. It is preferred that the rollers that are designed to contact the thoracic and lumbar portions of the spine be of unitary construction. Unitary rollers 40*b* and 40*c* may be provided with a central groove or reduced-diameter portion 41*b* and 41*c*, respectively. Such construction will allow the rollers to apply greater pressure along the sides of the spine.

Arms 38*a*, 38*b* and 38*c* are preferably of different lengths. Because of the different lengths of arms 38*a*, 38*b* and 38*c*, rotation of roller assemblies 36*a*, 36*b* and 36*c* about their points of attachment on the support rail will create different arcs of rotation 49*a*, 49*b* and 49*c* (see FIG. 2B), which enable a patient that is properly positioned on the table to obtain a better and more desirable contact pressure exerted by the rollers on his spine. The size of the rollers and the length of the arms are selected to provide anatomically correct and therapeutically beneficial massage to the various portions of the patient's spine. The preferred embodiment of the invention, as best shown in FIG. 2B, employs three roller assemblies, 36*a*, 36*b* and 36*c*, to apply therapeutic rolling pressure to the cervical, thoracic and lumbar portions, respectively, of the patient's spine.

If cut-out 28 is covered by the soft protective leather or vinyl material (not shown), as is preferred, the rollers will be less likely to pinch the patient on the table or to become entangled in his clothing as the roller assemblies rotate about their points of attachment on the support rail, thereby avoiding damage to the machine or injury to the patient.

Pivotal attachment of the support rail to the frame, as is preferred, allows one end of the rail to be raised and lowered with respect to the top of the table, such that the amount of pressure applied by the rollers to the patient's spine may be modified. By grasping handle 50 and squeezing locking release 52, the support rail may be raised or lowered to the desired location. Locking release 52 may then be engaged to lock the rail in the desired position by releasing a spring-loaded pin 56, that is mounted in handle 50, into one of several slots (not shown) in bracket 58. In an alternative embodiment (not shown), both ends of the support rail may be slidably mounted to a set of brackets attached to the frame so that either or both ends of the support rail can be raised or lowered relative to the table top and secured in place to position the roller assemblies in the desired location relative to the table top to apply the desired amount of therapeutic pressure to the spine of the patient.

Figure 3:
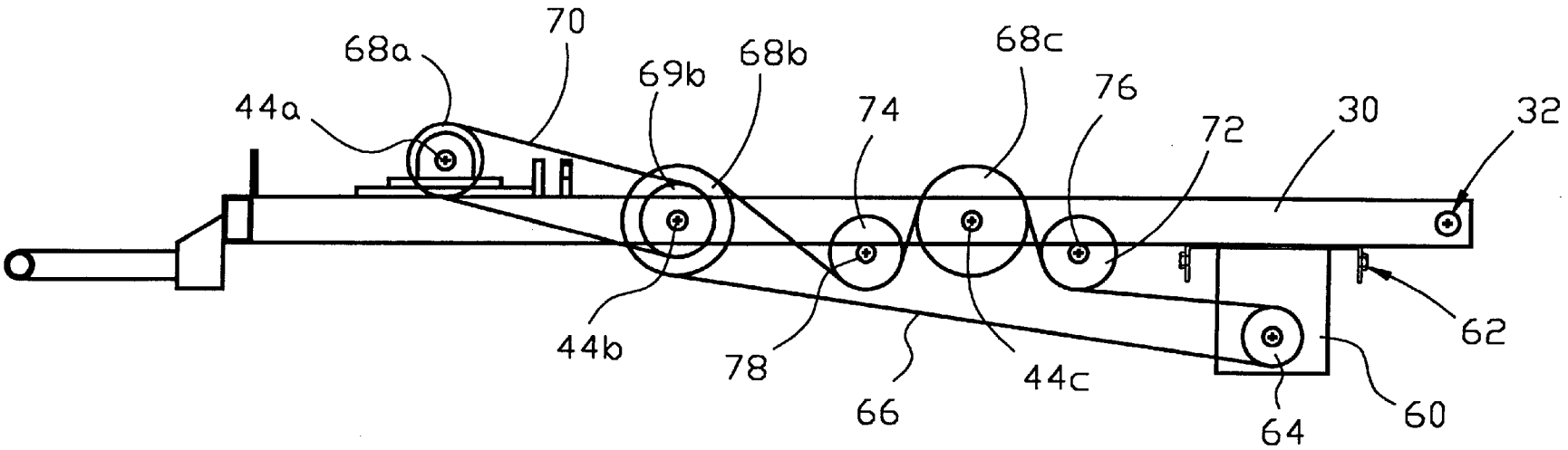
FIG. 3 is a view of a preferred embodiment of the means of rotation of the roller assemblies of the table of FIG. 1.

FIG. 3 illustrates a preferred embodiment of the means for rotating the roller assemblies 36*a*, 36*b* and 36*c* about their points of attachment on the support rail. Preferably, electric motor 60 is mounted by means of bracket assembly 62 of support rail 30. In the preferred embodiment of the invention, the roller assemblies are rotated about their points of attachment on the support rail in a sequence so as to simulate the effect of a single roller passing along the length of the spine of the patient. This may be accomplished by properly selecting the diameter of the rollers, the length of the arms, the positions of the points of attachment of the roller assemblies on the support rail and the sequence and rates of rotation of the roller assemblies. In the preferred embodiment illustrated in the drawings, motor 60 may be employed to drive wheel 64 (which optionally may be a pulley or sprocket), which is adapted to rotate roller assemblies 36*a*, 36*b* and 36*c*. As shown in FIG. 3, chain or drive belt 66 engages sprockets or drive wheels 68*b* and 68*c* that are mounted on pins 44*b* and 44*c*, respectively, of roller assemblies 36*b*and 36*c*. Secondary belt or chain 70 engages sprockets or drive wheels 69*b* and 68*a* that are mounted on pins 44*b* and 44*a*, respectively, of roller assemblies 36*b* and 36*a*. Belt 66 is kept at the proper tension and angle to turn drive wheels 68*b*, 69*b* and 68*c* (and through belt 70, wheel 68*a*) by guide wheels 72 and 74, which are secured for rotation about pivot points 76 and 78, respectively, that are located on or adjacent to support rail 30, so that the rollers will remain in a fixed rotational position relative to each another. The roller assemblies 36*a*, 36*b* and 36*c* are positioned in relation to one another along support rail 30 such that as arms 38*a*, 38*b* and 38*c* are rotated in a sequential and properly timed fashion, the respective rollers 40*a*, 40*b* and 40*c* will contact the spine of the patient 80 (see FIG. 2B), who is reclining on top 14 of table 10, in such a manner to simulate the effect of a single roller passing along the entire length of the patient's spine. Preferably, the roller assemblies will rotate in a counterclockwise direction as viewed in FIG. 2*b*, although table 10 can just as easily be configured to rotate the roller assemblies in the clockwise direction. In order for the preferred rotation to be achieved, motor 60 will turn drive wheel 64 in a counterclockwise direction. The cooperation of belts 66 and 70 will drive wheels 68*a* , 68*b*, 69*b* and 68*c* in a counterclockwise direction and guide wheels 72 and 74 in a clockwise direction.

Alternatively (although not shown in the drawings), each of the roller assemblies may be independently rotated about its point of attachment to the support rail. Independent rotation of each of the arms of the roller assemblies could be accomplished by use of a motor or other rotation means that is attached by means of a chain or belt to a sprocket or wheel that is mounted on each roller assembly, or by use of direct drive motors for each roller assembly.

As the roller assemblies rotate about their points of attachment on the support rail, they will rise within cut-out 28 to contact the patient's spine, either directly or through the soft cover of the table top. The extent to which the rollers 40 extend above the top surface of the table will be determined and controlled by the positioning of the adjustable support rail 30, the length of arms 38 and the diameter of rollers 40.

FIG. 2B illustrates the proper placement of patient 80 on top 14 of table 10. The patient should recline on the table top with his spine placed generally along the centerline of opening 28. This will allow the rollers to contact the spine when the roller assemblies are rotated about their points of attachment on the support rail. Depending on the amount of force to be applied by the rollers to the patient's spine, the height of support rail 30 may be set with respect to bracket 58 and locked into position. Preferably, the support rail has a vertical adjustment range of at least three inches. When the patient is placed in the proper position, the machine may be activated by means of a hand-held control (not shown) or a timer 82 (see FIG. 1) located on side panel 84 of table 10. The roller assemblies 36 will begin to rotate about their points of attachment on support rail 30. The patient can move up or down lengthwise or to the left or right side of the table during treatment if necessary to increase his comfort level. As shown in FIG. 2B, as each of roller assemblies 36*a*, 36*b* and 36*c* sequentially contact a portion of the patient's spine, they will apply therapeutic pressure thereto in an anatomically correct manner. Thus, assembly 36*a* is sized and configured so as to contact the cervical area of the spine. Similarly, assembly 36*b* is adapted to contact the thoracic area and roller assembly 36*c* is adapted to contact the lumbar region. Each of the rollers will apply pressure to a particular region of the patient's spine as they rotate through arcs 49*a*, 49*b* and 49*c*. When treatment has been begun, support rail 30 may be raised until the patient's individual pressure toleration level is reached. The typical treatment time will range between eight and twelve minutes, but should be no longer than about 30 minutes.

As has been mentioned, the roller assemblies will preferably rotate in a counterclockwise direction. As shown in FIG. 2B, roller assembly 36*b* is in position so that roller 40*b* is applying therapeutic pressure to the thoracic portion of the patient's spine. Once roller 40*b* rotates along arc 49*b* in a counterclockwise direction to a position that is just out of contact with the patient's spine, roller 40*a* will have rotated along arc 49*a* to a position of contact with the lower cervical region of the patient's spine. Once, roller 40*a* rotates along arc 49*a* in a counterclockwise direction to a position that is just out of contact with the cervical portion of the patient's spine, roller 40*c* will have rotated along arc 49*c* to a position of contact with the lower lumbar region of the patient's spine. This relative rotation of the roller assemblies will continue during treatment, giving the patient the sensation that a single roller is rolling up his spine from the lower lumbar region to the upper cervical region.

Although this description contains many specifics, these should not be construed as limiting the scope of the invention but merely as providing illustrations of the some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A therapeutic massage table for use in treating a patient, which table comprises:

a) a frame which is adapted for supporting a top upon which a patient may lie for treatment;

b) a linear support rail which is attached to the frame;

c) a plurality of roller assemblies, each of which includes an arm having a first end and a second end, said first end having a roller rotatably attached thereto, and said second end being rotatably attached to the support rail;

d) means for rotating the roller assemblies about their respective points of attachment on the support rail so as to move each roller through an arc and into contact with the patient on the table in a sequence one after another; wherein the position of the support rail with respect to the table top is such that when the roller assemblies are rotated about their points of attachment on the support rail, the rollers will apply pressure to the patient on the top of the table.

2. The table of claim 1, wherein the diameter of each roller, the length of each arm in a roller assembly and the points of attachment of the roller assemblies on the support rail are selected so that each roller will contact and apply pressure to a particular portion of the patient's spine.

3. The table of claim 1, wherein the roller assemblies are rotated about their points of attachment on the support rail so that each of the rollers will contact a region of the patient's spine in a sequence so as to simulate the effect of a single roller passing along the length of the spine of the patient.

4. The table of claim 1 which includes at least three roller assemblies.

5. The table of claim 4, wherein a first roller assembly is located on the support rail so as to contact the cervical portion of the patient's spine, a second roller assembly is located on the support rail so as to contact the thoracic portion of the patient's spine, and a third roller assembly is located on the support rail so as to contact the lumbar portion of the patient's spine.

6. The table of claim 1, wherein the support rail is capable of being raised or lowered relative to the frame to adjust the amount of pressure applied by the rollers to the patient's spine.

7. The table of claim 6, wherein one end of the support rail is pivotally attached to the frame, and the other end is adapted to be raised or lowered with respect to the top of the table.

8. A therapeutic device, designed to provide therapeutic musculoskeletal massage along the spine of a patient, said device comprising:

a) a table having a padded top;

b) a linear support rail mounted to the table;

c) a plurality of extension arms, each of which is rotatably attached to the support rail;

d) a plurality of massage rollers, one of which is mounted to each of the extension arms, wherein each of said massage rollers is sized to conform to a particular region of the average patient's spine; and e) means for rotating each of the extension arms about its point of attachment to the support rail, so that each of the massage rollers will contact a region of the patient's spine in a sequence so as to simulate the effect of a single roller passing along the spine of the patient.

9. The device of claim 8, wherein the number of rollers and extension arms is three.

10. The device of claim 8, wherein the means for rotating the extension arms comprises an electric motor.

11. The device of claim 8, wherein the support rail upon which the extension arms are mounted has a first and a second end and is pivotally attached at the first end to the table and adjustably secured to the table at its second end, such that said support rail may be raised and lowered to adjust the height of the rollers relative to the top of the table.

12. A method for providing a therapeutic massage for a patient, which method comprises:

a) providing a table comprising:

i) a frame which is adapted for supporting a top upon which a patient may lie for treatment;

ii) a linear support rail which is attached to the frame;

iii) a first, second and third roller assemblies, each of which includes an arm having a first end and a second end, said first end having a roller rotatably attached thereto and said second end being rotatably attached to the support rail, said roller assemblies being located so that upon rotation of the arm about its point of attachment to the support rail, the rollers will contact a patient on the top of the table, said first roller assembly being located on the support rail so as to contact the cervical portion of the patient's spine, said second roller assembly being located on the support rail so as to contact the thoracic portion of the patient's spine, and said third roller assembly being located on the support rail so as to contact the lumbar portion of the patient's spine;

iv) means for sequentially rotating each of said roller assemblies about its point of attachment on the support rail;

b) positioning the patient on his back on the table top;

c) rotating the first, second and third roller assemblies sequentially so as to simulate the effect of a single roller passing along the length of the spine of the patient.

* * * * *